US005417437A

United States Patent [19]

Coppard et al.

[11] Patent Number: 5,417,437

[45] Date of Patent: May 23, 1995

[54] DARTBOARD AND METHOD OF MANUFACTURE

[75] Inventors: Dudley F. Coppard, Tauranga; John W. McCormick, Katikati, both of New Zealand

[73] Assignee: Puma Dart Products Limited, Katikati, Netherlands

[21] Appl. No.: 169,632

[22] Filed: Dec. 20, 1993

[30] Foreign Application Priority Data

Dec. 23, 1992 [NZ] New Zealand ..... 245596

[51] Int. Cl.[6] ..... F41J 3/00

[52] U.S. Cl. ..... 273/403

[58] Field of Search ..... 273/403, 407, 408

[56] References Cited

U.S. PATENT DOCUMENTS

| | | | |
|---|---|---|---|
| 1,076,002 | 10/1913 | Clarke | 273/403 X |
| 1,453,396 | 5/1923 | Leggatt | 273/408 |
| 2,076,357 | 4/1937 | Tempest | 273/403 |
| 3,300,216 | 1/1967 | Haecker | 273/403 |
| 3,309,091 | 3/1967 | Haecker | 273/408 |
| 4,927,162 | 5/1990 | Kicks et al. | 273/408 |
| 4,982,967 | 1/1991 | Kicks | 273/408 |
| 5,188,372 | 2/1993 | Tadej | 273/408 |

FOREIGN PATENT DOCUMENTS

| | | | |
|---|---|---|---|
| 0495539A2 | 4/1992 | European Pat. Off. . | |
| 504959 | 5/1939 | United Kingdom | 273/408 |
| 2069854 | 9/1961 | United Kingdom . | |
| 981483 | 1/1965 | United Kingdom | 273/408 |
| 1553275 | 9/1979 | United Kingdom . | |
| 2026879 | 2/1980 | United Kingdom . | |
| WO8002742 | 12/1980 | United Kingdom . | |
| 2114902 | 9/1983 | United Kingdom . | |
| 2229373 | 9/1990 | United Kingdom . | |

*Primary Examiner*—William H. Grieb

*Attorney, Agent, or Firm*—Jones, Tullar & Cooper

[57] ABSTRACT

A dartboard including a bristle dartboard, an inner bull and an outer bull arranged concentrically on the bristle dartboard and a framework of interlocked, radial strips and circumferential strips mounted on the bristle dartboard to delineate different scoring segments, each radial strip being connected to the outer bull and a plurality of the radial strips being also connected to the inner bull.

5 Claims, 7 Drawing Sheets

DARTBOARD AND METHOD OF MANUFACTURE

In the case of dartboards which electronically score the darts as they hit the dartboard, it is common to have a base to the dartboard and a framework on the base that delineates between the different target segments. The target segments themselves are moveable to register the impact of a dan on each target segment. However, these dartboards are not used for competition play.

For the professional sport of darts, it is common to use a dartboard made from bristles known as a bristle board. A bristle dartboard is defined for the purposes of this specification and claims as being a dartboard made from pig bristle, vegetable fibre or synthetic fiber where the fibers are aligned approximately with the central axis through the circular face of the board. In use, this axis is substantially horizontal. The term "bristle dartboard" is used in the industry to cover those original dartboards made from pig bristle but which are now made from a vegetable fiber such as sisal and may alternatively be made from synthetic fibres. Of course, the general construction of such a dartboard approximates that of the original bristle dartboard.

Although metal strip dividers have been tried on bristle dartboards in the past, they have tended to move in the dartboard so that the target areas change shape as the dartboard continues to be used. This is unsatisfactory for apparatus used in a professional sport.

The present invention seeks to provide interlocking metal strips which provide a self-supporting framework to retain each of the metal strips in place and the framework as a whole or the strips individually can be pressed into a bristle dartboard to provide the final dartboard. The pressing in of the metal strips allows the bristle board to support the metal strips so that no other retention means is necessary such as staples or the like as well as allowing only thin metal strips to be used which provide less of an obstruction than conventional wires.

Therefore, it is an object of the present invention to overcome some of the disadvantages of the prior art and/or at least provide the public with a useful choice.

Accordingly, the present invention consists in a dartboard comprising:

a bristle dartboard as hereinbefore defined; and a framework of interlocked, radial strips and circumferential strips positioned within said bristles of said dartboard to delineate between different scoring segments.

Accordingly, in a second aspect, the present invention consists in a method of manufacturing a dartboard comprising:

manufacturing or obtaining a bristle dartboard;

constructing a framework of intersecting strips; and pressing said framework into the bristle dartboard to delineate the variety of target segments on the dartboard.

Accordingly, in yet a further aspect, the present invention consists in a method of manufacturing a dartboard comprising:

manufacturing or obtaining a bristle dartboard as hereinbefore defined; and pressing individual interlocking radial and circumferential strip dividers into the bristle dartboard to form a framework within said dartboard to delineate the variety of target segments on the dartboard.

In an alternative form, each strip may be placed in the bristle dartboard in sequence to provide the entire framework.

The present invention consists in the foregoing and also envisages constructions of which the following are examples.

One preferred form of the present invention will now be described with reference to the accompanying drawings in which.

The present invention comprises a dartboard (not shown) made from bristles known as a bristle board. The bristle board has a framework of radial and circumferential thin strips inserted in the dartboard to act as delineators between various target segments.

Figure 1:
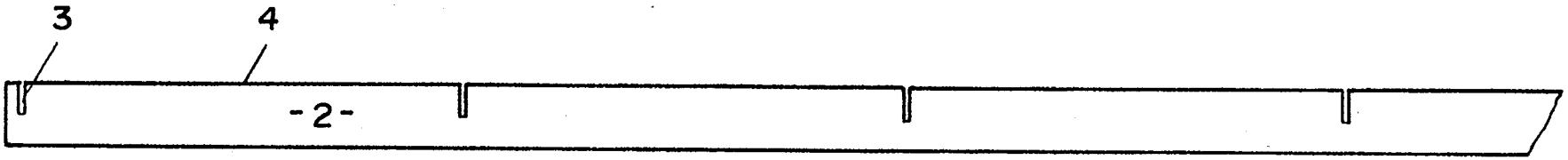
FIG. 1 is an elevational view of a strip of material suitable as a circumferential divider on the outside of the double region of a dartboard.

As shown in FIG. 1, a thin strip, preferably of metal, may be provided to fit around the circumference on the outside of the double point scoring region on a dartboard. The strip 2 has slots 3 progressing from one edge 4 of the strip 2 and progressing a substantial portion of the way across the strip 2. However, the slot does not progress across the entire width and thereby break the strip into sections.

Figure 2:
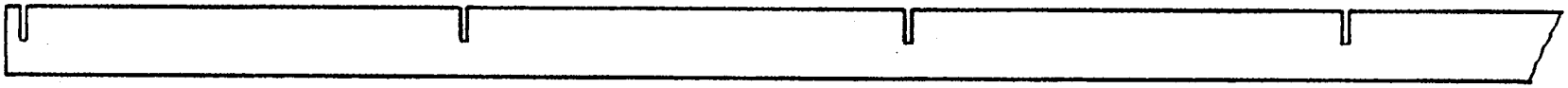
FIG. 2 is an elevational view of a strip of material suitable for use as the inner double divider on a dartboard.
Figure 3:
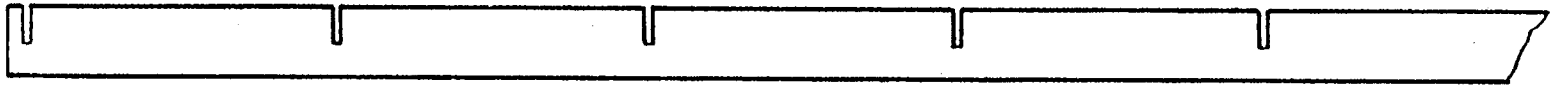
FIG. 3 is an elevational view of a strip of material suitable for use as the outer treble divider on a dartboard.
Figure 4:
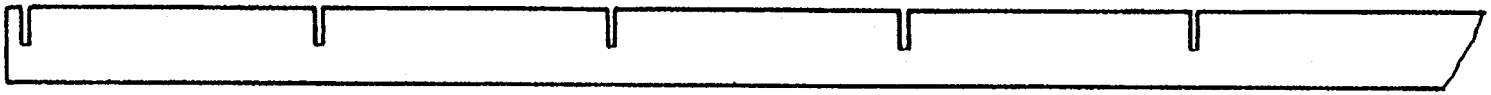
FIG. 4 is an elevational view of a strip of material suitable for use as the inner treble divider on a dartboard.

FIGS. 2, 3 and 4 all show similar circumferential strip dividers for, respectively, the inside of the double region, the outside of the treble region and the inside the treble region.

Each of these strips should continue to provide 21 slots to accommodate the radials progressing from the center of the dartboard.

The spacing between each of the slots reduces from FIG. 1 through to FIG. 4. This is to accommodate the different spacing between radials at the position of each of the circumferential strips. In the case of the outer double, the distance between slots should be approximately 52.87 mm. In the case of the inner double in FIG. 2, this should be 49.87 mm. In the case of the outer treble in FIG. 3, this should be 32.91 mm. In the case of the inner treble in FIG. 4, this should be 29.92 mm.

Twenty one slots are provided so that there is some overlap between the two ends of the circumferential strip and the two slots, one at each distal end connect onto the same radial.

Alternatively, other joining means for the ends of the strip could be used and in some circumstances the strip may not be joined.

All the measurements mentioned above for the distance between the slots are determined from a standard dartboard, however, some slight variation may be allowed.

Figure 5:
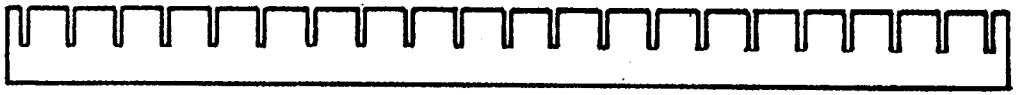
FIG. 5 is an elevational view of a strip of material suitable for use as the outer bull divider on a dartboard.

As shown in FIG. 5, the outer bull can be of the same general form as the other circumferential strips but having only a 4.99 mm spacing between the slots.

Figure 6:
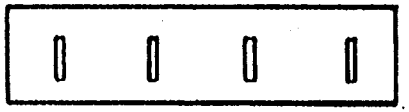
FIG. 6 is an elevational view of a strip of material suitable for use as the inner bull divider on a dartboard.

As shown in FIG. 6, a different form of inner bull has been used. In the case of the inner bull shown in FIG. 6, the slots are provided in the center of the strip and are designed to interlock below the surface of the dartboard.

In an alternative form, a solid strip could be provided for the inner bull if it is found that the inner bull is sufficiently stable in its own right not to be interlocked with the radials.

In alternative forms of the present invention the 25 ring and the bull ring may be made from a tabular material.

Figure 7:
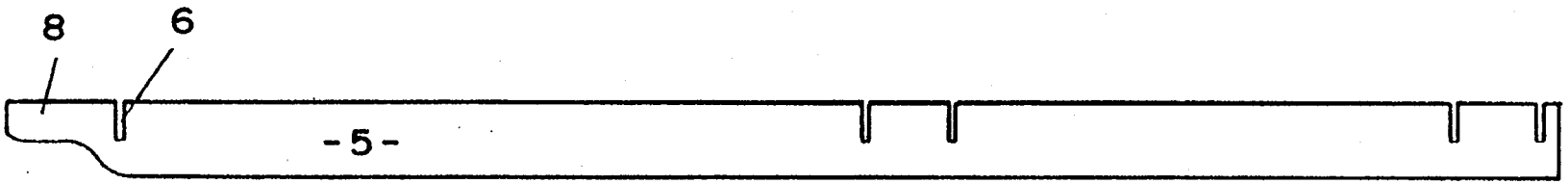
FIG. 7 is an elevational view of a strip of material suitable for use as a radial divider.
Figure 8:
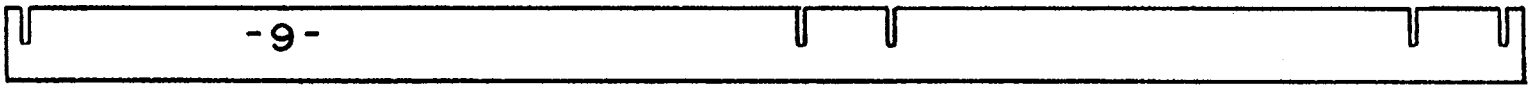
FIG. 8 is an elevational view of a strip of material suitable as a radial divider.

Referring now to FIGS. 7 and 8, dartboard radials 5 may be provided with slots 6 to accommodate the intersection with the circumferential strips.

In the preferred form, two forms of dartboard radials are provided. The difference between the two types of radials is that the radial 5 shown in FIG. 7 has an additional end section 8 for intersection with the inner bull. In contrast, the strip divider 9 in FIG. 8 has no similar end region and is designed to terminate at the outer bull circumferential divider.

By using two different forms of dartboard radials, selected radials of the form shown in FIG. 7 can be used to intersect with the inner bull and the majority of radials left terminating at the outer bull circumferential, The progression of all twenty radial dividers into the inner bull may make the construction of the inner bull too delicate. Furthermore, there is no necessity for any radial delineation between segments between the outer bull and the inner bull. The entire ring area known as the outer bull scores the same. In fact, any progression of radials near the surface through this area may be undesirable as it may increase the risk of darts striking these strips and falling out.

Each of the thin metal strips may be provided with a tapered leading edge for that edge designed to be adjacent the front scoring face of the dartboard. A tapered leading edge will increase the chances of a dan being deflected by the strip into the dartboard rather than striking a blunt edge and bouncing out.

Similarly, the edge distal from the front face of the dartboard may also be tapered to assist in the insertion of the strip divider into the bristle dartboard. In the preferred form, both edges are tapered.

Figure 9:
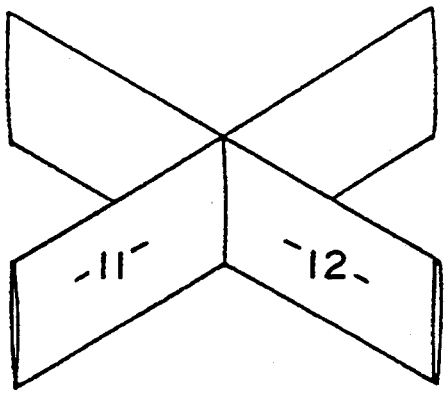
FIG. 9 is a perspective view of a part of the framework showing two interlocking metal strips.

In the manufacture of such a dartboard, the dartboard radials and circumferential strip dividers are manufactured and a framework may be built up by interlocking each of the interlocking strips. A typical intersection between two strip dividers 11 and 12 is shown in FIG. 9.

Figure 10:
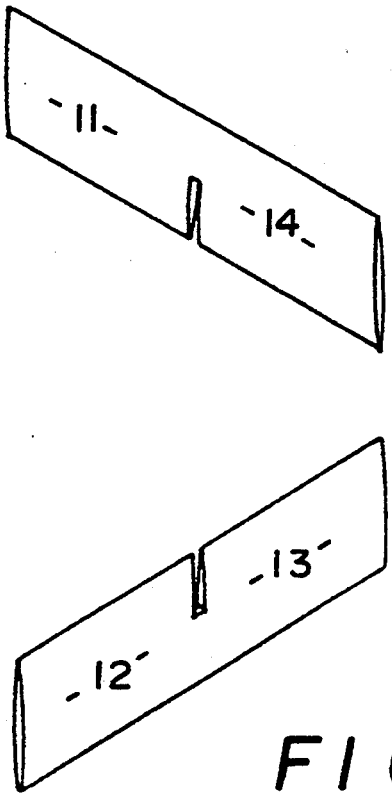
FIG. 10 is a perspective view of the construction of FIG. 9 in exploded position.

FIG. 10 shows the strips just prior to interlocking engagement. It is to be noted that the interlocking slots 13 and 14 progress from adjacent edges of the strips and they may be inter-engaged to form the complete framework. Once the framework is completed, the entire framework may be pressed into the bristle board to form the completed dartboard.

In an alternative form of construction, each strip could be placed into the dartboard to interlock with the other strips as it is placed, however, this may not allow for the strip dividers to support each other quite as well as if the framework is manufactured and pressed in as a whole.

In a preferred form of the present invention, the metal strips will progress from the front face or target scoring face of the dartboard through a substantial portion of the bristle board but not entirely through the bristle board. Pressing the framework through the entire board would cause the bristle board to be cut into segments between each of the framework strips and would require a backing to the board to stop the adjacent target segments from moving axially out of the framework.

It is only the inner bull circumferential shown in FIG. 6 which is not a necessary part of the framework. All the other strips interlock, however, the inner bull may be of a conventional form, the interlocked form shown in FIG. 6 or a simple annular ring pressed into the board in the desired place and relying on support from the bristle board itself.

Once a framework is pressed into the bristle board, both the framework and the bristle board support each other to provide the finished article.

Figure 11:
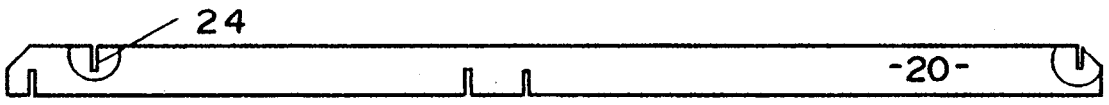
FIG. 11 is an elevational view of a strip of material suitable as a radial divider.
Figure 12:
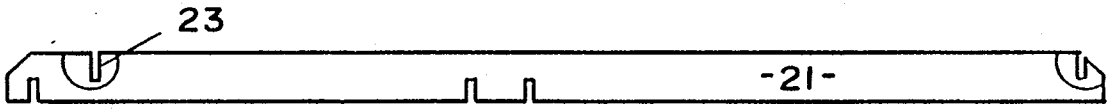
FIG. 12 is an elevational view of a strip of material suitable as a further divider.
Figure 13:
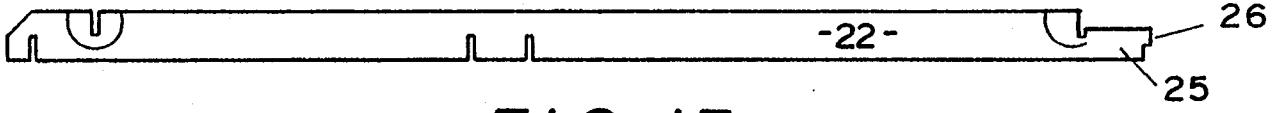
FIG. 13 is an elevational view of a strip of material suitable as a yet further radial divider.

In a further preferred embodiment, the framework may comprise radial strips 20, 21 and 22 as shown in FIGS. 11, 12 and 13 respectively. Fifteen radial strips 20 as shown in FIG. 11 can be used as the dividers between various sectors of the dartboard. Another radial 21 may be used which incorporates wider slots for the intersection with the circumferential strips, These wider slots allow for some overlap of the ends of the circumferential strips. Therefore, each of the slots 23 on the radial arm 21 are made wider than the slots 24 on the normal radial strips 20.

Figure 14:
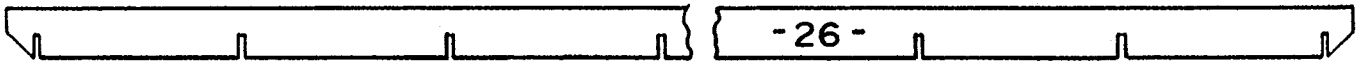
FIG. 14 is an elevational view of a strip of material suitable as a circumferential divider.
Figure 15:
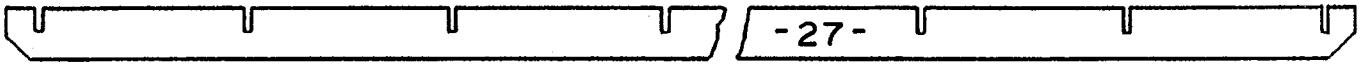
FIG. 15 is an elevational view of a strip of material suitable as a further circumferential divider.
Figure 17:
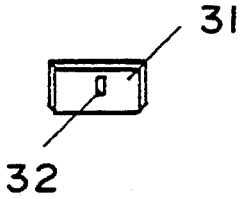
FIG. 17 is an elevational view of a ring of material suitable as a divider to delineate the inner bull on a dartboard.

A further radial strip 22 may be employed in the framework. This radial strip is similar to the radial strip 20 but adds an extension 25 including a projection 26 for intersection with the inner bull circumferential. The inner bull circumferential 31 as shown in FIG. 17 provides only four equi-spaced rectangular holes 32 around the perimeter. In this preferred embodiment, four radial arms 22 must also be equi-spaced to match with the holes 32 and the inner bull 31. In another preferred embodiment, three radial arms such as those shown as 22 may be used to match with only three holes similar to hole 32 in the inner bull 31 to hold the inner bull in place. Again, in the case of three radial arms 22 interconnecting with the inner bull 31, it may be desirable to equi-space these radial arms about the board and correspondingly equi-space the holes 32 about the circumference of the inner bull 31. Of course, if the holes 32 are not equi-spaced around the perimeter of the inner bull 31, a corresponding shift of the positions of the four radial strips 22 is necessary. The circumferentials for this preferred embodiment comprise circumferential strips 26 and 27 as shown in FIGS. 14 and 15. It is intended that the three circumferentials 26 used as circumferentials at the inner treble, outer treble and outer double lines on the dartboard have their 21 slots at centers of 30.90 mm, 33.62 mm and 53.41 mm and total lengths of 624.84 mm, 679.04 mm and 1074.7 mm respectively. Although some minor variation to these measurements may be acceptable, these are in accordance with necessary measurements for a standard dartboard.

The circumferential to mark the inner double line on a dartboard is made with 21 slots at 50.70 mm centres and a total length of 1020.68 mm and is intentionally placed with the slots on the other side from those as shown in FIG. 14 on the strip 26. This is so that the circumferential 27 may intersect with slots such as those numbered 23 and 24 on the radial strips 21 and 20. In the arrangement as shown, the reversing of at least one of these circumferential strips from the orientation of the others allows for a greater degree of support in the framework as a whole.

Figure 16:
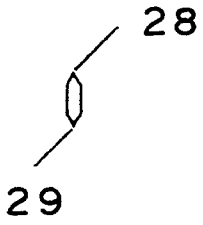
FIG. 16 is a cross-sectional view through a strip of material suitable as acting as either a radial or a circumferential divider.

In cross-section, the strips are generally of the cross-section as shown in FIG. 16. It should be noted that each of the edges of the strip 28 and 29 reduce to a point at the edge so as to provide an ease of entry for the framework into the bristle board in one direction and provide a thinner strip on the face of the dartboard which is less likely to deflect thrown darts out of the dartboard.

Figure 18:
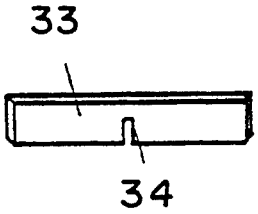
FIG. 18 is an elevational view of a ring of material suitable as delineating the outer bull on a dartboard.

The tuner bull 31 and the outer bull 33 of the framework are shown in FIGS. 17 and 18, respectively. Unlike the previous embodiment, each of these dividers 31 and 33 are now made from thin wailed stainless steel tube rather than the strip as used in the previous embodiment. This is merely for convenience and ease of production in the manufacturing of such small circumferentials. It should be noted that in FIG. 18, twenty equi-spaced notches 34 are provided around the perimeter although only one is shown for clarity.

Figure 19:
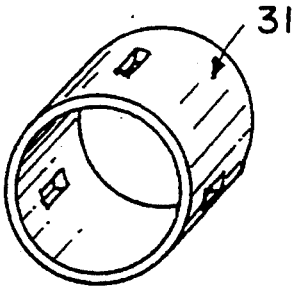
FIG. 19 is a perspective view of an assembled ring of materials as a divider to delineate the inner bull on a dartboard.
Figure 20:
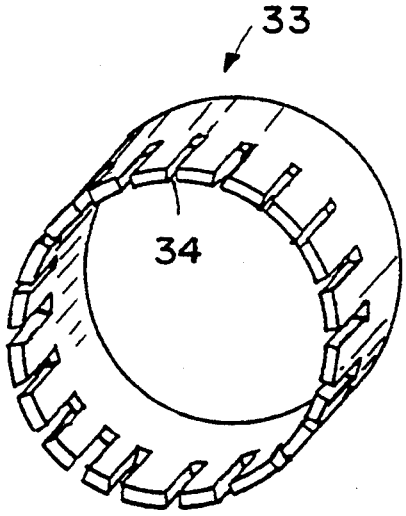
FIG. 20 is a perspective view of an assembled ring of materials suitable as a divider to delineate the outer bull on a dartboard.

The inner bull 31 is also illustrated in FIG. 19. The outer bull 33 is shown in FIG. 20 which also illustrates the 20 equi-spaced notches 34 around the perimeter.

As with the previous embodiment, the radial and circumferential strips interlock to form a complete framework which may then be pushed into a bristle board to form the completed dartboard. Alternatively, the radials and circumferentials could be placed in sequence into the dartboard to complete the dartboard.

If it is necessary to provide greater support for the strip when inserted in the dartboard, provision can be made for any number of the radial strips to be extended beyond the outside double strip and staples could be affixed over the extended radial strips in the non-scoring areas of the dartboard for additional securing purposes.

Figure 21:
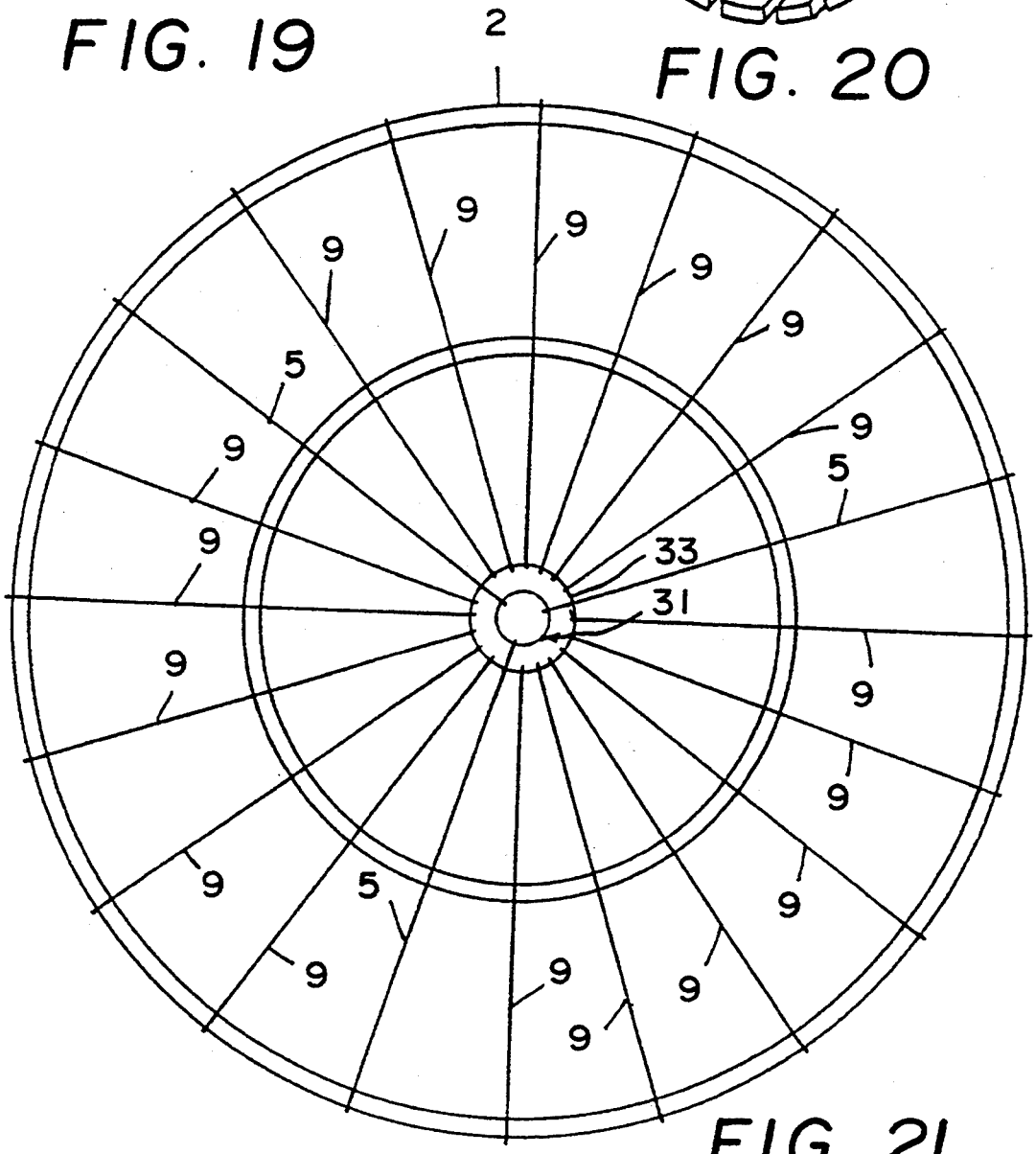
FIG. 21 is a elevational view of an assembled dartboard according to at least one form of the present invention.

One form of the assembled dartboard is illustrated in FIG. 21 showing the inter-relationship of radials and circumferentials. This assembled drawing shows the arrangement of the radials and the circumferentials according to the various embodiments that the present invention that is the various different dividers are used to produce a substantially similar arrangement.

The various dividers that is radials and circumferentials may be manufactured from metal strip for example stainless steel strip. However they may also be produced from metal strip which is coated in plastic or from suitable types of plastic itself.

The bristle dartboard and network of interlocking radial and circumferential strips of material may be used in conjunction with sensing means to provide an electronic scoring dartboard and machine. A dartboard constructed in the manner of the present invention may use the divider strips in a bristle dartboard to delineate between the target segments on an electronic dartboard.

What we claim is:

1. A dartboard, comprising a bristle dartboard;

an inner bull and an outer bull arranged concentrically on the bristle dartboard; and a framework of interlocked, radial strips and circumferential strips mounted on the bristle dartboard to delineate different scoring segments, each radial strip being connected to the outer bull and a plurality of the radial strips being also connected to the inner bull.

2. The dartboard as defined in claim 1, wherein the outer bull includes a plurality of slots equal in number to the number of radial strips.

3. The dartboard as defined in claim 1, wherein the inner bull includes a plurality of openings spaced equally about its circumference for receiving an end of a respective radial strip.

4. The dartboard as defined in claim 2, wherein each radial strip includes a plurality of spaced apart slots for receiving a circumferential strip and for being received in a corresponding slot in the outer bull.

5. The dartboard as defined in claim 4, wherein the inner bull includes a plurality of opening spaced equally about its circumference for receiving an end of a respective radial strip.

* * * * *